United States Patent [19]

Costa

[11] Patent Number: 4,603,246

[45] Date of Patent: Jul. 29, 1986

[54] HAIR DRYER FOR PROFESSIONAL AND DOMESTIC USE

[75] Inventor: Giancarlo Costa, Milan, Italy

[73] Assignee: Olimpic di Costa Lorenzo & C. s.n.c., Milan, Italy

[21] Appl. No.: 645,601

[22] Filed: Aug. 29, 1984

[51] Int. Cl.[4] ..... A45D 20/12

[52] U.S. Cl. ..... 219/370; 219/366; 34/97

[58] Field of Search ..... 219/366, 367, 368, 369, 219/370, 371, 372, 373, 374; 34/96, 97, 243 R; 16/110.5, 111 R, 112; 403/146, 116, 117, 86, 84

[56] References Cited

U.S. PATENT DOCUMENTS

| | | | |
|---|---|---|---|
| 672,303 | 4/1901 | Williams | 403/84 |
| 1,540,326 | 6/1925 | Glowa | 403/86 |
| 2,742,936 | 4/1956 | Cooley | 403/86 |
| 3,986,272 | 10/1976 | Feierabent | 219/370 |
| 4,198,558 | 4/1980 | Benty | 219/370 |

FOREIGN PATENT DOCUMENTS

| | | | |
|---|---|---|---|
| 2528056 | 1/1977 | Fed. Rep. of Germany | 219/370 |
| 2743743 | 4/1979 | Fed. Rep. of Germany | 219/370 |
| 421405 | 3/1967 | Switzerland | 219/370 |

*Primary Examiner*—Clarence L. Albritton
*Assistant Examiner*—Teresa J. Walberg
*Attorney, Agent, or Firm*—Karl F. Ross; Herbert Dubno

[57] ABSTRACT

A hair dryer, designed to be used both professionally and domestically, has a generally cylindrical body with a nozzle for the discharge of a flow of hot air generated in its interior, this body having secured thereto a saddle-shaped base to which an inclined handle is attached under spring pressure with the aid of a bolt perpendicular to the body axis. The base and the handle adjoin each other along surfaces parallel to that axis for enabling the handle to be rotated through 180° between two extreme positions in which the handle respectively slants toward the rear and the front of the body. The relative rotation is limited by a semicircular cutout in the handle penetrated by a pin rigid with the base.

6 Claims, 4 Drawing Figures

HAIR DRYER FOR PROFESSIONAL AND DOMESTIC USE

FIELD OF THE INVENTION

My present invention relates to a hair dryer usable both domestically and professionally.

BACKGROUND OF THE INVENTION

In principle, hair dryers usable by a professional in a beauty parlor and those suitable for use in the home do not differ very much from each other. The basic distinction, however, resides in the position of a handle which in the first instance must be easily gripped by a hairdresser standing behind a seated customer and in the second instance must be conveniently held by the person whose hair is being dried.

Conventional hair dryers commonly available have come to adopt a compromise solution with the handle disposed at right angles to the axis of the generally cylindrical body serving for the generation of a flow of hot air discharged by a nozzle at one end of the body. This solution does not fully satisfy the requirements of either a professional or a private user. The alternative of manufacturing two sets of hair dryers for household and for the shop is burdensome.

OBJECT OF THE INVENTION

Thus, the object of my present invention is to provide a hair dryer which can be readily adjusted for either type of use.

SUMMARY OF THE INVENTION

I realize this object, in accordance with my present invention, by securing a base substantially midway to the periphery of the hair-dryer body and providing it with a contact surface substantially parallel to its axis. The handle, securable by fastening means to that base, has a coacting surface inclined to its centerline at an acute angle of less than 45°, this coacting surface coming to lie flat against the contact surface of the base. With the fastening means designed to enable relative rotation of the body and the handle about a line perpendicular to the two contacting surfaces, a handle is able to occupy two diametrically opposite positions in which it respectively slants toward the rear and the front of the body.

The base, advantageously, is generally saddle-shaped.

According to a more particular feature of my invention, the fastening means may comprise a bolt which is centered on the aforementioned perpendicular line and anchored to the base while traversing an end wall of the handle forming its coacting surface. With the aid of spring means engaging a free end of the bolt while bearing upon that end wall, the handle is firmly urged against the base.

I further prefer to provide the end wall of the handle with a generally semicircular cutout which is penetrated by a pin on the base of the body for limiting the relative rotation of the handle to 180°. This cutout can also give passage to an electric supply line serving to energize the heating and blowing means inside the body.

BRIEF DESCRIPTION OF THE DRAWING

The above and other features of my present invention will now be described in detail with reference to the accompanying drawing in which.

SPECIFIC DESCRIPTION

Figure 1:
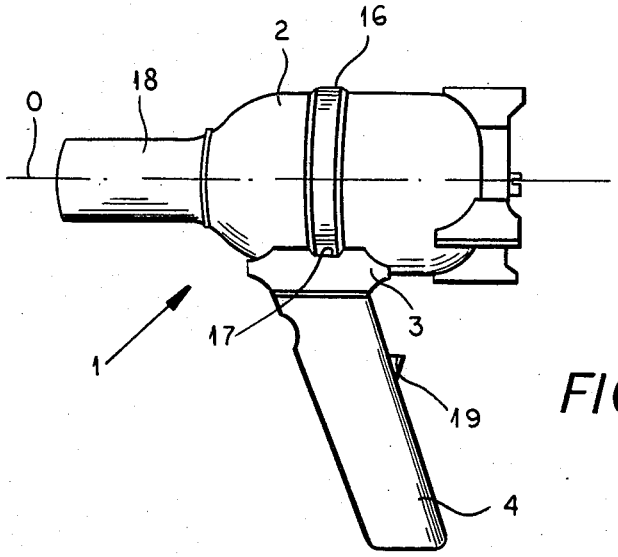
FIG. 1 is a side-elevational view of my improved hair dryer adjusted for professional use.
Figure 2:
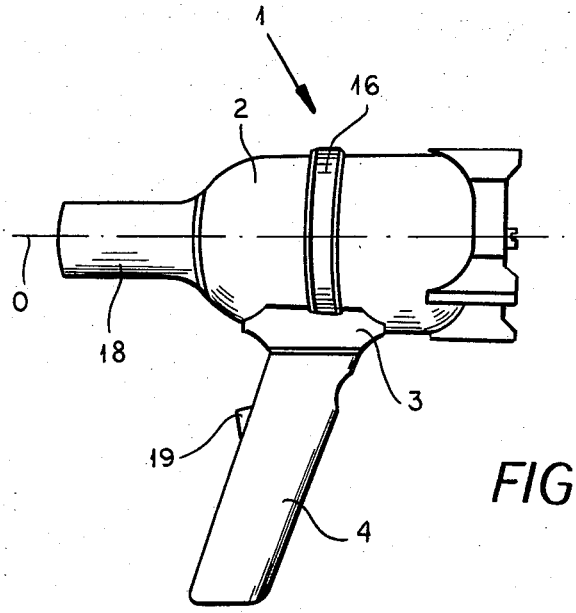
FIG. 2 is a view similar to FIG. 1, showing the hair dryer adjusted for domestic use.
Figure 3:
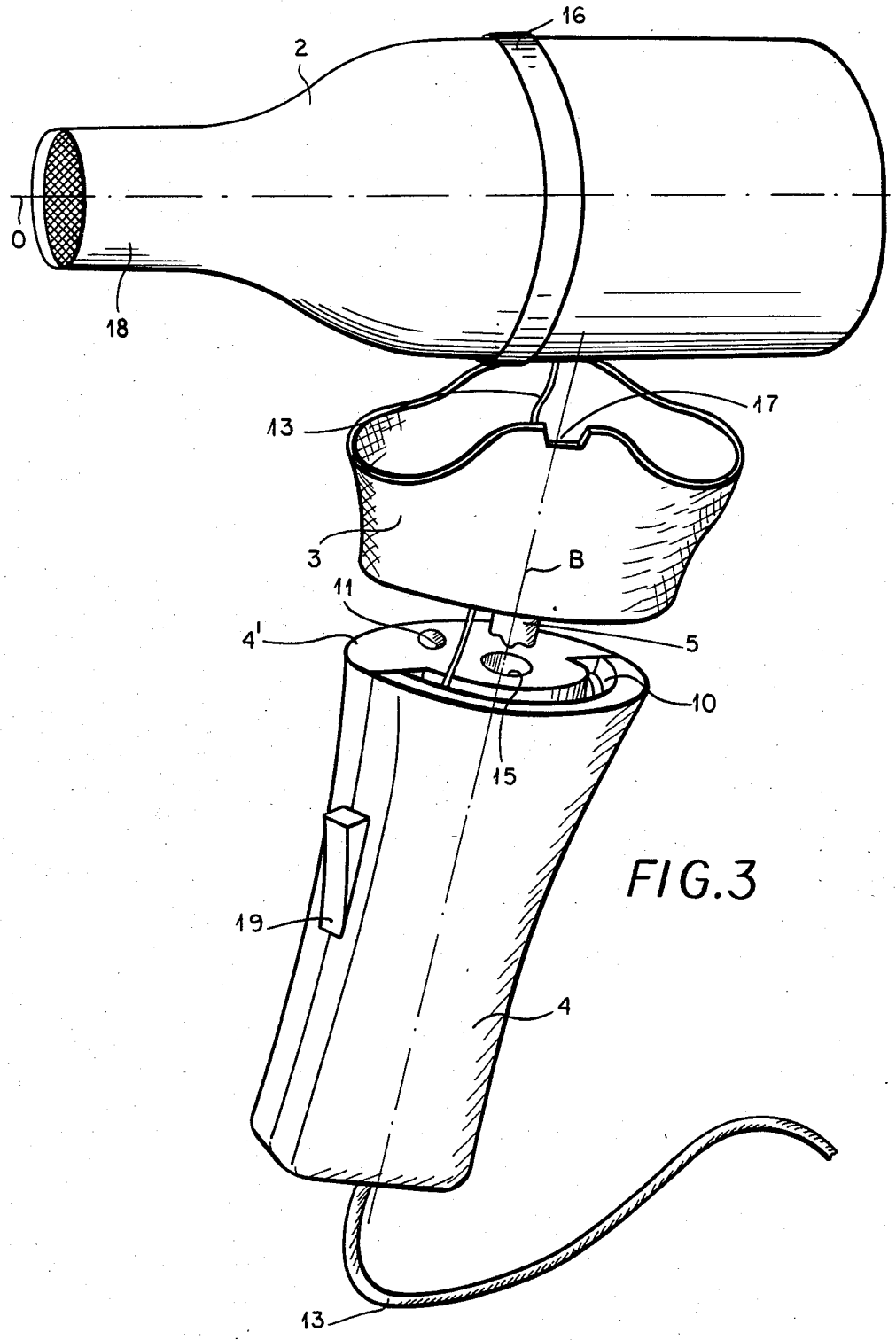
FIG. 3 is an axonometric exploded view of the hair dryer, drawn to a larger scale.
Figure 4:
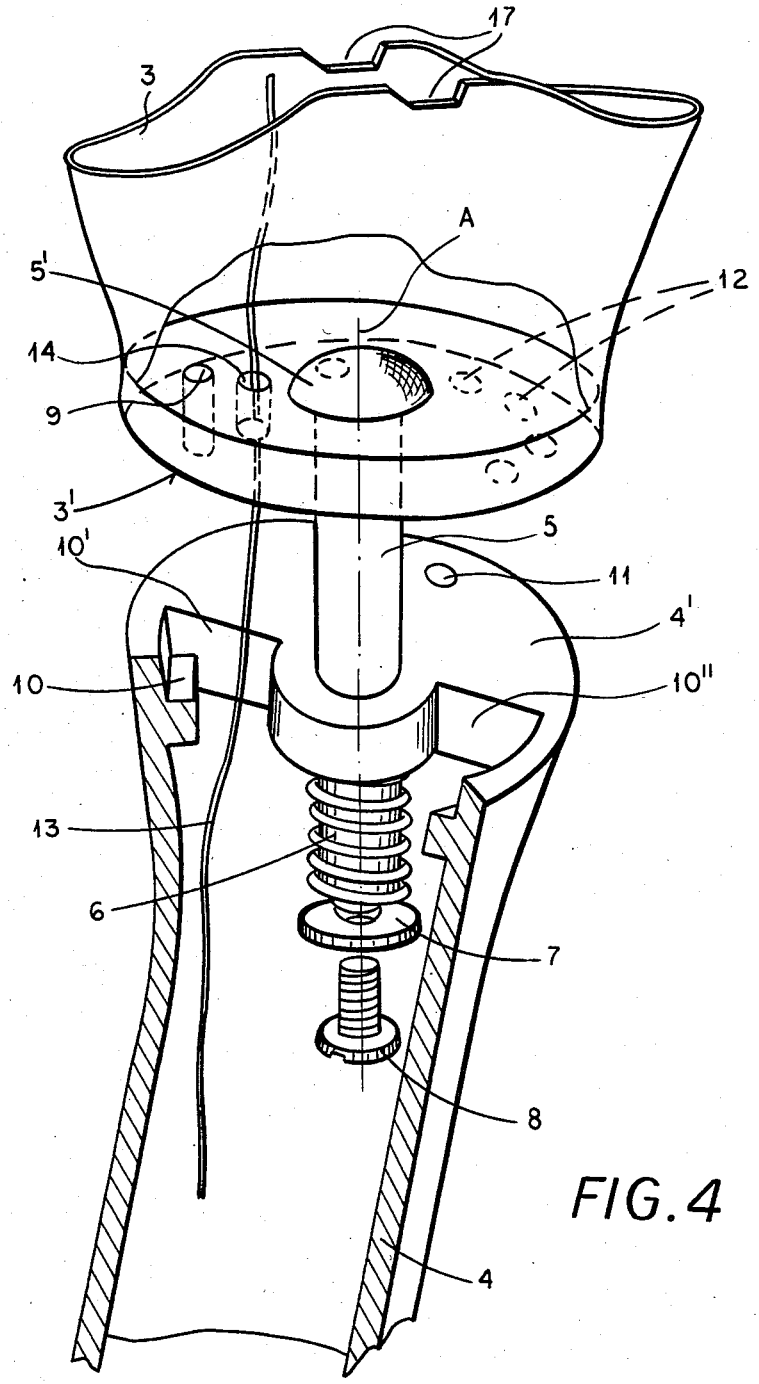
FIG. 4 is a sectional detail view of the hair dryer, illustrating the coupling between its base and its handle.

The hair dryer shown in the drawing, generally designated 1, has a substantially cylindrical body 2 which is centered on an axis 0 and contains conventional means for generating a hot-air stream exiting at a nozzle 18. Body 2 has a peripheral groove occupied by a slightly projecting ring 16 which enters a pair of recesses 17 on opposite edges of a saddle-shaped base 3 to locate it in a predetermined position relative to the body. Base 3 has a flat underside 3' serving as a contact surface confronting a coacting flat surface 4' at the upper end of a hollow handle 4 which is partly closed by a wall having a semi-circular cutout 10 bounded by diametrically opposite faces 10', 10''. A central hub flanked by faces 10' and 10'' is traversed, perpendicularly to surface 4', by a bolt 5 which also passes through a central hole of the bottom of base 3, with a knob 5' resting on that bottom. Bolt 5 is centered on an axis A (FIG. 4) which is inclined at an acute angle to the centerline B of handle 4 seen in FIG. 3. The lower end of bolt 5 is internally threaded and engaged by a screw 8 which, through the intermediary of a washer 7, compresses a coil spring 6 between that washer and the end wall of handle 4, thereby tightly holding surfaces 3' and 4' onto each other. That pressure, however, is not so strong as to prevent a relative rotation of handle 4 about the axis of bolt 5 between the positions of FIGS. 1 and 2.

A pin 9 eccentrically depending from base 3 projects into the cutout 10 to limit that rotation to an angle of 180°. Surface 3' is provided with several depressions 12 selectively engageable, in the end positions and also in intermediate positions of rotation, by a detent 11 of the usual ball-check type serving to stabilize the handle with reference to the base. An electric supply line 13 with a non-illustrated plug extends into body 2 by way of cutout 10 and an eccentric aperture 14 in the bottom of base 3, that aperture so guiding the line 13 as to prevent its entanglement with bolt 5.

A trigger 19 on handle 4 serves for turning the hair dryer on and off.

I claim:

1. A hair dryer for professional and domestic use, comprising:

a generally cylindrical body having an axis and provided with a nozzle at one end for the discharge of an internally generated flow of hot air generally from a front of said body at said end and opposite a rear of said body;

a base secured to said body substantially midway therealong and provided with a contact surface substantially parallel to the axis of said body;

a handle with a coacting surface inclined at an acute angle of less than 45° to a centerline of said handle; and fastening means securing said handle to said base with said coacting surface lying flat against said contact surface, said fastening means enabling relative rotation of said body and said handle about a line perpendicular to said surfaces between two diametrically opposite positions in which said handle respectively slants toward the rear and the front of said body and affixing said handles exclusively and selectively in each of said positions whereby an axis of said handle is inclined to but intersects said axis of said body.

2. A hair dryer for professional and domestic use, comprising:

a generally cylindrical body having an axis and provided with a nozzle at one end for the discharge of an internally generated flow of hot air generally from a front of said body at said end end opposite a rear of said body;

a base secured to said body substantially midway therealong and provided with a contact surface substantially parallel to the axis of said body;

a handle with a coacting surface inclined at an acute angle of less than 45° to a centerline of said handle; and fastening means securing said handle to said base with said coacting surface lying flat against said contact surface, said fastening means enabling relative rotation of said body and said handle about a line perpendicular to said surfaces between two diametrically opposite positions in which said handle respectively slants toward the rear and the front of said body, said fastening means comprising a bolt centered on said perpendicular line and anchored to said base, said bolt traversing an end wall of said handle forming said coacting surface, and spring means engaging a free end of said bolt while bearing upon said end wall for firmly urging said handle against said base.

3. A hair dryer as defined in claim 2 wherein said end wall has a generally semicircular cutout penetrated by a pin on said base for limiting said relative rotation to 180°.

4. A hair dryer as defined in claim 3 wherein said surfaces are provided with indexing means for yieldably arresting said handle and said base in a plurality of intermediate relative positions.

5. A hair dryer as defined in claim 3 wherein said base has an aperture radially offset from said pin, said body being provided with an electric supply line guided by said aperture for passage through said cutout and said handle.

6. A hair dryer as defined in claim 2 wherein said base is generally saddle-shaped.

* * * * *